United States Patent [19]

Bau

[11] 4,014,584

[45] Mar. 29, 1977

[54] DEVICE FOR RETRIEVING ANIMAL WASTE

[76] Inventor: Marcel Bau, 89 Van Ness Court, Maplewood, N.J. 07040

[22] Filed: Nov. 24, 1975

[21] Appl. No.: 634,821

[52] U.S. Cl. ..... 294/19 R; 294/1 R

[51] Int. Cl.[2] ..... A47F 13/06

[58] Field of Search ..... 294/19 R, 1 R, 50.5, 294/50.6, 50.7, 50.8, 50.9, 55, 100, 115; 119/1 R; 15/257.1, 257.6; 220/315

[56] References Cited

UNITED STATES PATENTS

| | | | |
|---|---|---|---|
| 3,733,098 | 5/1973 | Tobias | 294/19 R |
| 3,738,697 | 6/1973 | Kahan | 294/19 R |
| 3,841,686 | 10/1974 | Gallo et al. | 294/1 R |

*Primary Examiner*—James B. Marbert
*Attorney, Agent, or Firm*—Silverman and Jackson

[57] ABSTRACT

A device for retrieving waste deposits particularly animal feces, excrement and the like, comprising a first tubular shaft having a distal or handle end portion and a proximal end portion, the latter terminating in a first stop. A second shaft, concentrically disposed within said first shaft and movable longitudinally with respect thereto, terminates in a second stop positioned outwardly of said first stop. Longitudinal movement of the second shaft causes a pair of opposed frame members rotatably mounted in, or attached to the second stop and connected to the first stop by e.g., rods, to opposedly rotate to open or closed positions in jaw-like fashion.

2 Claims, 9 Drawing Figures

FIG. 4
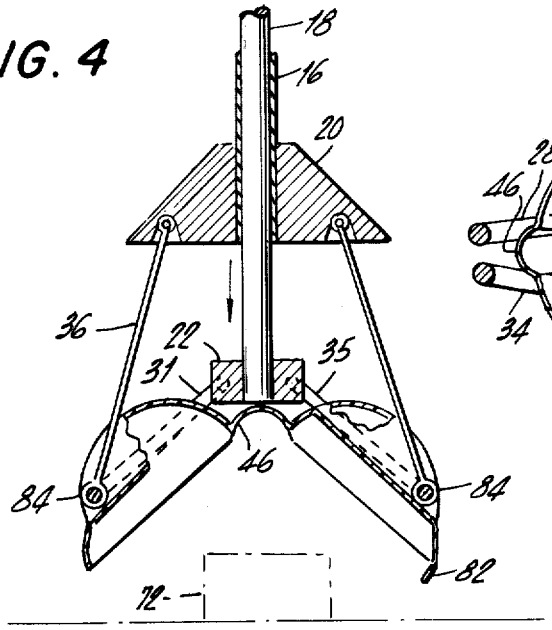
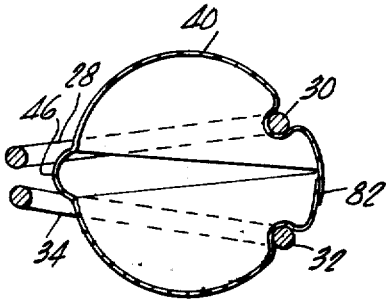
FIG. 7
FIG. 5
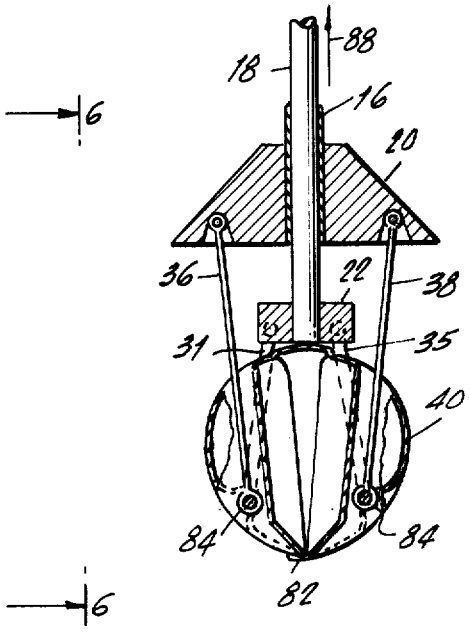
FIG. 6
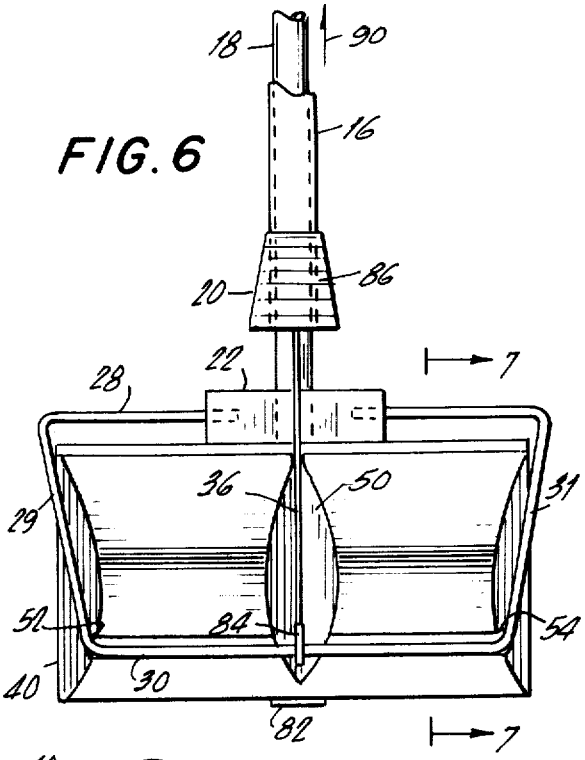
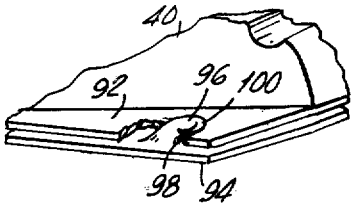
FIG. 8

DEVICE FOR RETRIEVING ANIMAL WASTE

BACKGROUND OF THE INVENTION

1. Field of the Invention

The invention relates generally to a device for retrieving waste deposits and particularly for the effective and expeditious retrieval of animal feces, excrement and the like, the device being portable and adapted to be used by simple hand manipulation thereof.

2. Description of the Prior Art

As is well known, the population of domesticated pets such as dogs, cats and the like is ever-increasing and particularly in urban areas. Effective retrieval of animal waste deposits and particularly dog feces has thus become a matter of considerable official concern due to possible risk to public health created by resultant unsanitary conditions not to be mention the general inconvenience to the public. In many intances, localities, municipalities etc., have enacted regulations, ordinances and the like restricting areas permitted for animal waste deposits to certain designated areas such as public litter boxes. However, as will further be understood, it is often times unavoidable as a practical matter to comply with such regulations despite the fact that the dog may be leashed and under the control of the master.

In such instances it was heretofore necessary to resort to rather cumbersome methods for retrieving the feces in a sanitary manner which would be unoffensive to the master. Thus, the usual devices provided for such purposes included a container for retaining the feces and a separate instrument or tool of some kind for guiding the feces into the container. Such devices are often bulky and awkward making transport and handling thereof quite difficult. Moreover, repetitive use of such devices necessarily entails difficult cleaning problems and accordingly, devices of this type are objectionable from an aesthetic as well as a functional standpoint.

Thus, a primary object of the invention is to provide a device for the retrieval, transport and disposal of animal feces wherein the foregoing and related disadvantages are eliminated or at least mitigated to a substantial extent.

A further object of the invention is to provide such a device advantageously adapted to be hand-carried in convenient manner— and of streamlined, lightweight construction.

A still further object of the invention is to provide such a device wherein the unsanitary aspects normally incident to the retrieval and disposal of animal feces are substantially alleviated.

Another object of the invention is to provide such a device capable of efficient use with a minimum of physical exertion e.g., bending, stooping and the like, required on the part of the user.

Yet another object of the invention is to provide such a device enabling retrieval, transport and disposal of animal feces, the device having an interchangeability of parts feature conducive to repetitive sanitary use.

Still another object of the invention is to provide such a device which may be easily cleaned with a minimum of effort.

Yet a further object of the invention is to provide such a device having an arrangement of parts conducive to simple and inexpensive manufacture.

Other objects and advantages of the invention will become more apparent from the following discussion and reference to the accompanying drawings wherein:

BRIEF DESCRIPTION OF THE DRAWINGS

FIG. 4 is a sectional view similar to FIG. 2 A shown partly broken away and illustrating the position of the proximal end portion of the device just prior to waste deposit retrieval;

FIG. 5 is an exploded sectional view similar to FIG. 4 illustrating the proximal end portion of the device in closed position for transport of the retrieved waste deposit;

FIG. 6 is a view taken along the line 6—6 in FIG. 5;

FIG. 7 is a view taken along the line 7—7 in FIG. 6 and

FIG. 8 is a sectional detailed view of a modified closure for the scoop member.

DETAILED DESCRIPTION OF THE INVENTION

Figures 1, 2, 2A, 3:
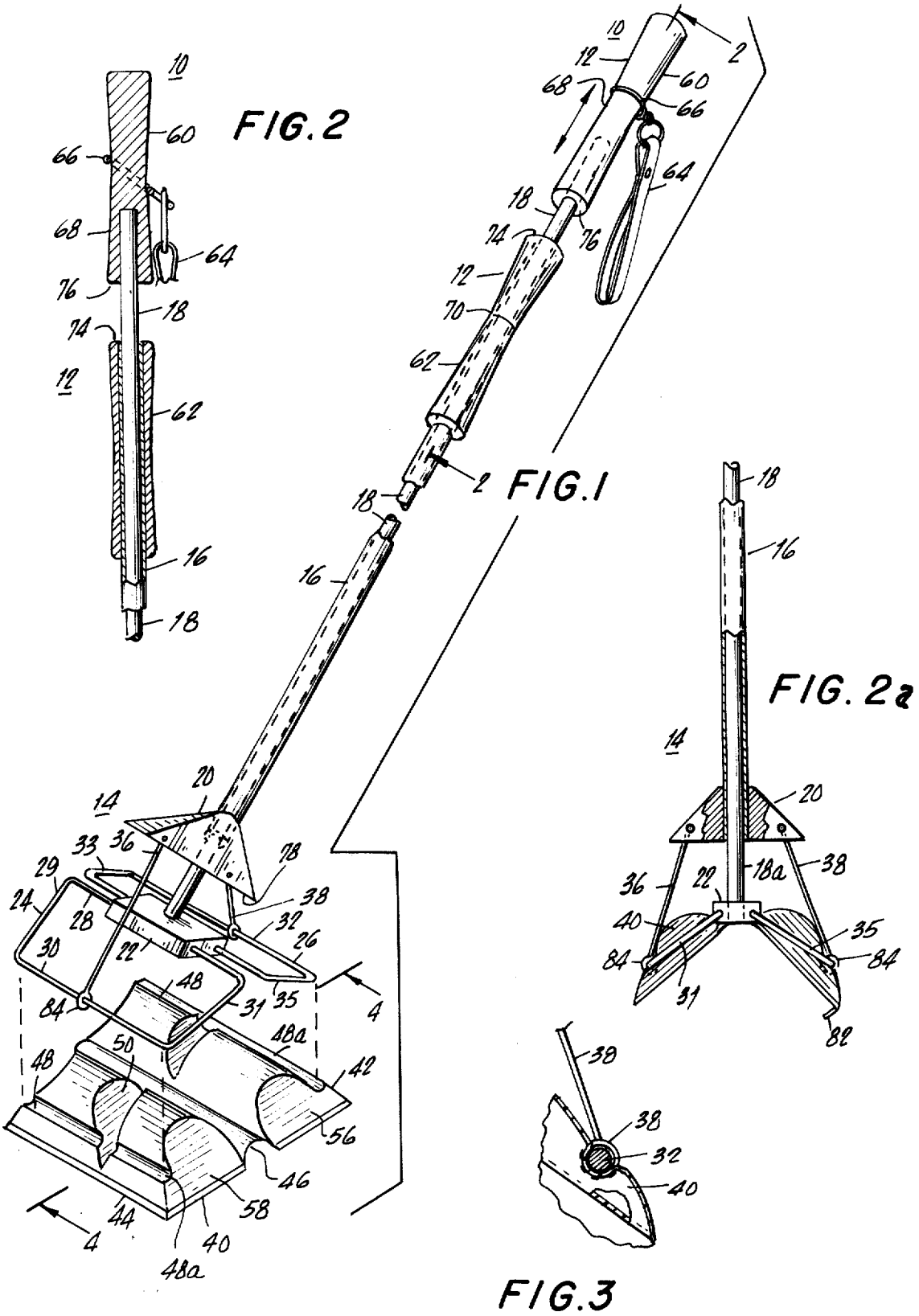
FIG. 1 is a perspective view of a device in accordance with the invention.
FIG. 2 is a sectional view taken along the line 2—2 in FIG. 1 illustrating the distal end portion of the device.
FIG. 2*a* is a sectional view taken along the line 2—2 in FIG. 1 and illustrating the proximal end portion of the device.
FIG. 3 is an exploded view taken along A in FIG. 2A.

The invention is described by reference to the accompanying drawing wherein like reference numerals refer to similar parts throughout the several views and wherein reference numeral 10 generally designates a waste deposit retrieval device in accordance with the invention having a distal or handle end portion 12 and a proximal end portion 14 connected by a first or outer shaft 16 and concentrically disposed inner shaft 18 longitudinally movable with respect to said outer shaft 16. Outer shaft 15 terminates at proximal end portion 14 in first stop means 20 illustrated here as comprising a block member of solid triangular cross section. Shaft 16 is fixedly secured to stop 20 and thus stationary therewithin. Inner shaft 18 extends outwardly of stop 20 and of distal end portion 14 as indicated at 18A and terminates in stop 22, being fixedly secured thereto. Stop 22 may comprise a simple block member, illustrated in FIG. 1 as being of rectangular cross section. Opposed wire frame members 24 and 25 which may be of simple rectangular design as illustrated in FIG. 1, are each provided with a pair of transverse members designated 28, 30 and 32 and 34 respectively. Inner transverse members 28 and 34 are rotatably mounted in stop 22 e.g. by slots, not shown, serving as seating means for the inner transverse members. So positioned, frame member 24 and 26 are opposedly rotatable about transverse members 28 and 34, the latter serving as axis means, to a position of relatively large angular displacement (open position) as illustrated in FIGS. 1, 2A and 4 and a position wherein said frame members are adjacently positioned (closed position) as illustrated, for example, in FIG. 5. Outer transverse members 30 and 32 are connected to stop 20 by suitable means such as stabilizer rods 36 and 38.

The retrieval or "scoop" portion of the device preferably comprises a separate member 40 adapted to be snap-fitted to frame members 24 and 26 and comprising opposed identical wing members 42 and 44 connected by flexure axis 46, wing members 42 and 44 are provided with grooves 48, 48A and 50. When snap-fitted to frame emmbers 24 and 26, transverse members 30 and 32 are seated into their corresponding grooves as best illustrated in FIG. 6. Scoop member 40 may be of suitable film-forming polymeric plastic material e.g. polyvinyl chloride, poly-ethylene and the like having good flexibility, resistance to cracking, dimensional stability and the like. Flexure axis portion 46 is preferably of arcuate e.g. concave, configuration as illustrated in FIG. 1 and is sufficiently thin, resilient and crack-resistant to enable rotation of members 42 and 44 and associated frame members 24 and 26 thereabout to open and closed position as previously described.

FIG. 2A illustrates a sectional view of the device 10 in at least partially open position with scoop member 40 detachably attached to the associated frame members 24 and 26. For purposes of improved structural stability, grooves 48 and 48A may terminate in rounded end portions 52 and 54 (FIG. 6) which provide additional seating area for frame members 24 and 26 and particularly the end portions of longitudinal rods 29, 31, 33 and 35. In attached position, rods 29, 31, 33 and 35 tightly, frictionally engage the sidewall portions 56 and 58 (FIG. 1) of scoop member 40. The scoop member thus positioned is frimly attached to frame members 24 and 26 and remains stable in place under the conditions of use of device 10.

The distal end portion 12 of device 10 and its operating relationship to the proximal end portion 14 of device 10 is best illustrated in FIG. 1. Inner shaft 18 terminates distally in inner handle portion 62. For purposes of ease of transport, outer handle portion 60 may be additionally provided with appended hand grip 64 which is attached to outer handle portion 60 by any conventional means e.g. screw, nail, tack or equivalent means, or alternatively by loop means 66 tied to handle portion 60. In this regard, hand portion 60 may taper inwardly as illustrated in FIG. 1 to provide a narrowed central portion 68 thus facilitating hand-gripping of device 10. An inner handle portion 62 may be similarly designed to provide a narrowed central portion 70. It will be understood that the design aspects of the handle portions 60 and 62, as discussed, are not essential aspects of the invention herein described but are given for purposes of illustration only.

Handle portions 60 and 62 are preferably of segmented construction as illustrated in FIG. 1. This mode of construction is preferred since it aids the user in most effectively applying the force necessary to operate device 10 as will be evident from the following.

In actual use, and with scoop member 40 attached as described, the device 10 is operated by causing frame members 24 and 26 and associated members 42 and 44 to rotate about transverse members 28 and 34 to the position desired. This is achieved by merely applying a pulling or pushing force to handle portion 60 with one hand, while resisting the directional force applied by firmly gripping handle portion 62 with the other hand. Rotation of frame members 24 and 26 to open position (FIGS. 2A and 4) from the closed position illustrated for example in FIG. 5 is effected by applying a pushing force to handle portion 60, such force being transmitted to shaft portion 18 and directed essentially longitudinally with respect thereto. Inner shaft 18 and associated stop member 22 are caused to move in a direction proximally of device 10, the extent of such movement being limited by the distance separating the facing surfaces 74 and 76 of handle segments 60 and 62. This distance may be calibrated as desired to accordingly control the extent of the opposed rotation of frame members 24 and 26 toward the open position. If desired, such distance may be of sufficient extent to permit frame members 24 and 26 to reach a substantially coplanar position, i.e., the angular displacement therebetween approximating 180°, or beyond for that matter. As illustrated in FIGS. 2A and 4, the mentioned angular displacement is less than 180° but somewhat in excess of 90°. However, limitations with respect to this aspect are largely a matter of design and within the discretion of the manufacturer.

Whereas, surfaces 74 and 76 function as stop means limiting rotation of frame members 24 and 26 to the open position, stop members 20 and 22 may similarly function to limit rotation of frame members 24 and 26 to the closed position. Closing of frame members 24 and 26 is simply effected by merely reversing the procedure explained in connection with achieving the open position i.e., by firmly gripping the respective handle segments as described and applying a pulling force to handle segment 60. Inner shaft 18 and associated stop member 22 are thus withdrawn in a direction distally of device 10, the longitudinal withdrawal movement continuing until stop 22 comes into abutting relationship with stop 20 i.e., contact of facing surfaces 78 and 80. Again, the distance between facing surfaces 78 and 80 can be calibrated so as to control the relative positioning of frame members 24 and 26 at the closed position e.g., approximately parallel as illustrated in FIG. 5. In any event, at the closed position, frame members 24 and 26 will be substantially, adjacently positioned. As illustrated in FIGS. 1 and 2A, for example, the depth of sidewalls 56 and 58 of scoop member 40 extending below grooves 48 and 48A and thus below transverse members 30 and 32 can be varied, the essential requirement being that the opposed facing surfaces of members 42 and 44 be in contact to provide a sealing closure when scoop member 40 is in closed position. To facilitate retrieval of animal feces, such as illustrated at 72 in FIG. 4, scoop member 40 may be provided with an overlying lip portion 82 which aids in lifting the feces to a position enabling efficient capture and containment thereof by continued closure of scoop member portions 42 and 44.

As previously mentioned, transverse members 28 and 24 are rotatably seated within stop member 22. Longitudinal movement of inner shaft 18 exerts a pushing a pulling force, as the case may be, directed essentially normally to the longitudinal axis of transverse members 28 and 34. Since the distance between outer transverse members 30 and 32 and stop member 20 is fixed by rods 36 and 38 connecting these members, longitudinal movement of inner shaft 18 necessarily causes rotation of transverse members 28 and 34 and correspondingly, opening or closing of scoop member 40. Connecting, stabilizing rods 36 and 38 terminate in looped end portions 84 which slippingly engage outer transverse members 30 and 32 the latter being thus free to rotate. Rods 36 and 38 are accommodated by grooves 50 provided in scoop member 40 thus effectively increasing the extent to which frame members 24 and 26 can be rotated to open position.

In a further embodiment and as particularly illustrated in FIG. 5, stop member 20 may be provided with coil spring means which urges inner shaft 18 toward the distal end 12. Thus, the force necessary to close scoop member 40 about the feces specimen 72 can be supplied by the release of tension built up in spring means 86 upon opening of scoop member 40.

FIGS. 5, 6 and 7 further illustrate the closed position of frame members 24 and 26 with scoop member 40 attached. Thus, FIG. 5 is similar to FIG. 4 with scoop member 40 in closed position but shown partly broken away. Longitudinal movement of inner shaft 18 toward the distal end of device 10, as indicated by directional arrows 88 and 90 in FIGS. 5 and 6 respectively, would of course cause rotation of scoop member 40 to open position. These figures illustrate the tight sealing enclosure obtainable with the scoop-frame assembly described herein.

FIG. 8 illustrates a sectional view of a modified closure for the scoop member 40. In this embodiment, a scoop member, such as illustrated in FIG. 1 (40) is provided with flange members 92 and 94 integral with and extending outwardly from the bottom edge portions of sidewalls 56 and 58 as well as the opposed sidewalls (not show in FIG. 1). The shape of flange members 92 and 94 is discretionary; for example, they may extend angularly outwardly from the outer bottom edges of sidewalls 56 and 58 terminating in an apex thus providing overall triangularly shaped portions. Mating opposed flange members close upon each other when the scoop member is in closed position as illustrated for example in FIG. 5. To secure the closed position, one of the opposed flange members such as 94 in FIG. 8 is provided with an upwardly extending lug portion 96 undercut at 98 to provide an outward head portion 100. Opposed flange member 92 is provided with an opening in an area directly opposite to lug 96. Closure of flange members 92 and 94 is achieved by simply first forcing head portion 100 thru the opening provided in flange 92 until the respective flange members are in substantially abutting contact. The diameter of the opening approximates that of the lug 96 the latter taken at its undercut portion. In this manner, the respective flange members can be detachably, snap-fitted to achieve a secured, closed position. Flange members 92 and 94 may be disengaged by merely applying a downwardly directed force to lug 96 whereby to force same through the opening provided in the opposed, mating flange member.

As an alternative to the foregoing, the respective flange members can be provided with an adhesive coating, deposit etc. to enable, repetitive sealing closure of the scoop member.

Members 20 and 22, referred to as stop members herein for arresting movement of scoop member 40 to closed position need not come into abutting relationship upon closure. Thus, member 20 may serve as support means for outer shaft 16 and stabilizer rods 36 and 38 while member 22 may serve as support means for inner shaft 18 and transverse members 28 and 34. Note the relative position of support members 20 and 22 as illustrated in FIGS. 5 and 6 (closed position). The term "stop member" as used herein with respect to members 20 and 22 is, accordingly, to be interpreted having reference to the foregoing discussion. The device 10 may be constructed of suitable plastic material, such as the film-forming resinous polymers hereinbefore described as well as metal such as light-weight aluminum. In any event, detachable scoop member 40 is preferably of plastic material and, being interchangeable, can be cleaned and reused or alternatively thrown away depending on the user's wishes.

A latitude of modification, substitution and change is intended in the foregoing disclosure, and in some instances, some features of the invention may be employed without a corresponding use of other features.

What is claimed is:

1. Device for retrieving waste material comprising first tubular shaft having a distal handle end portion and a proximal end portion terminating in a first stop means, a second shaft concentrically disposed within said first shaft and extending outwardly of said proximal end portion and terminating in a second stop means, said second shaft being movable longitudinally with respect to said first shaft, a pair of opposed frame members each having a first transverse member rotatably attached to said second stop means and a second transverse member pivotally attached to said first stop means said frame members being opposedly rotatable about said first transverse members upon longitudinal movement of said second shaft, longitudinal movement of said second shaft toward said proximal end portion causing said frame members to opposedly rotate to an open position wherein said frame members are mutually angularly displaced, longitudinal movemement of said second shaft toward said distal end portion causing said frame members to opposedly rotate to a closed position wherein said frame members are substantially adjacently positioned in which said first shaft terminates distally in a first-handle means and said second shaft terminates distally in a second-handle means positioned outwardly of said first-handle means, said first and second handle means comprising separate members.

2. Device according to claim 1 wherein said first and second handle means are in abutting relationship when said frame members are in open position.

* * * * *